United States Patent [19]

Pickard

[11] 4,402,265

[45] Sep. 6, 1983

[54] MAGNETIC PRINTING SADDLE

[75] Inventor: John E. Pickard, San Antonio, Tex.

[73] Assignee: Beach Manufacturing Corporation, Huntington Beach, Calif.

[21] Appl. No.: 250,884

[22] Filed: Apr. 3, 1981

Related U.S. Application Data

[63] Continuation of Ser. No. 961,470, Nov. 16, 1978, abandoned.

[51] Int. Cl.[3] ..... B41F 27/02; B41F 27/12

[52] U.S. Cl. ..... 101/382 MV; 101/415.1; 101/378

[58] Field of Search ..... 101/382 MV, 415.1, 378; 51/176, 275, 370, 362–367

[56] References Cited

U.S. PATENT DOCUMENTS

| | | | |
|---|---|---|---|
| 2,707,433 | 5/1955 | Roberts | 101/382 MV |
| 3,108,538 | 10/1963 | Barnes | 101/415.1 |
| 3,126,825 | 3/1964 | Tofano | 101/415.1 |
| 3,217,645 | 11/1965 | Martt | 101/415.1 |
| 3,603,255 | 9/1971 | Horner | 101/378 |
| 3,670,646 | 6/1972 | Welch | 101/382 MV |
| 3,734,017 | 5/1973 | Trier et al. | 101/378 |
| 4,191,106 | 3/1980 | Fermi et al. | 101/415.1 |

*Primary Examiner*—Edgar S. Burr
*Assistant Examiner*—David A. Wiecking
*Attorney, Agent, or Firm*—Fulwider, Patton, Rieber, Lee & Utecht

[57] ABSTRACT

There is disclosed, printing apparatus including a drum having oppositely facing semicylindrical saddles mounted thereon with elongated spaces between the edges of the saddles. The longitudinal edges of the saddles are beveled radially inwardly on themselves and an elongated laminated alternate pole magnet array is mounted in the space between the saddles. A flexible printing plate is provided along one edge thereof with an inwardly bent angle for engaging the beveled edge of the saddle and the opposite edge of the plate is provided with a lockup pad for magnetically engaging the elongated magnet in the space.

9 Claims, 7 Drawing Figures

FIG. 1
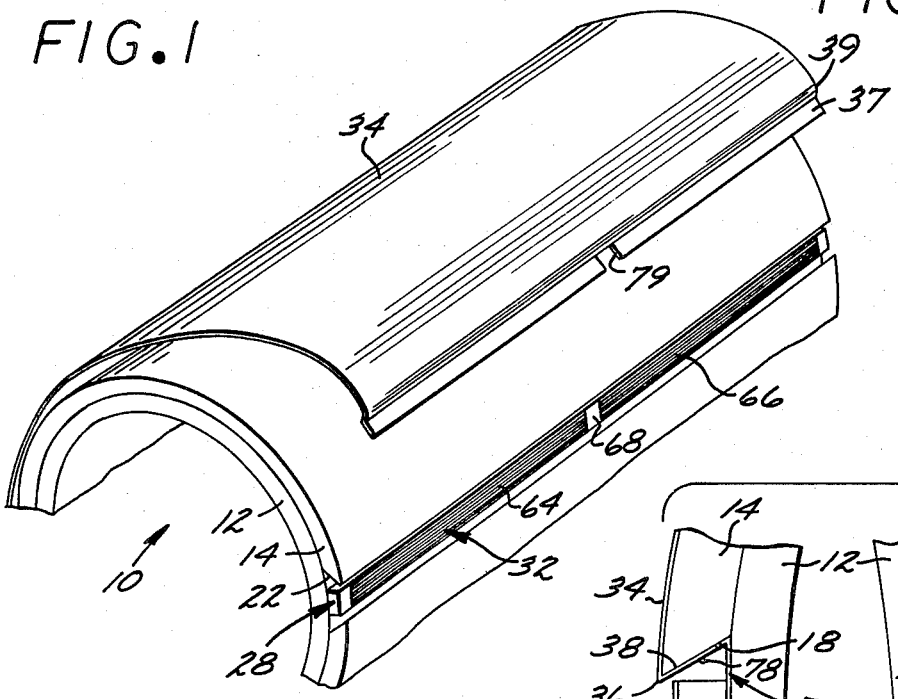
FIG. 6
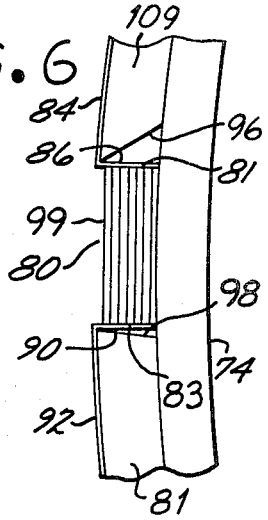
FIG. 2
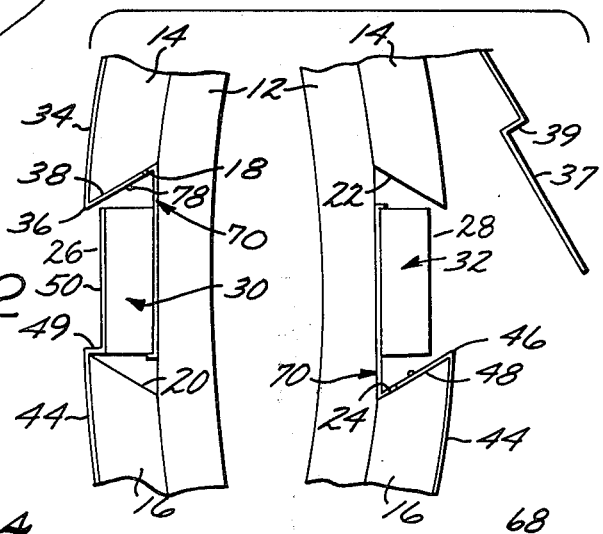
FIG. 3
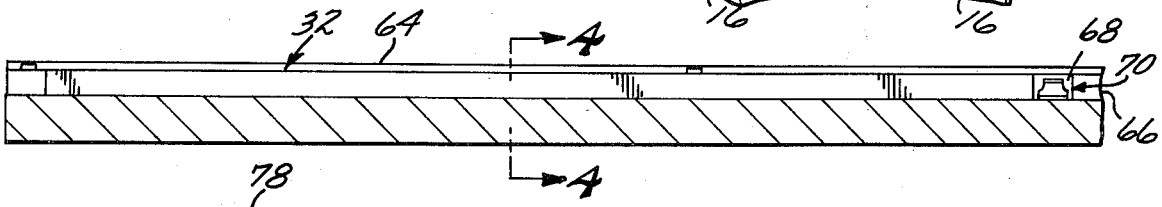
FIG. 7
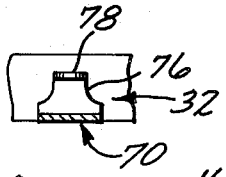
FIG. 5
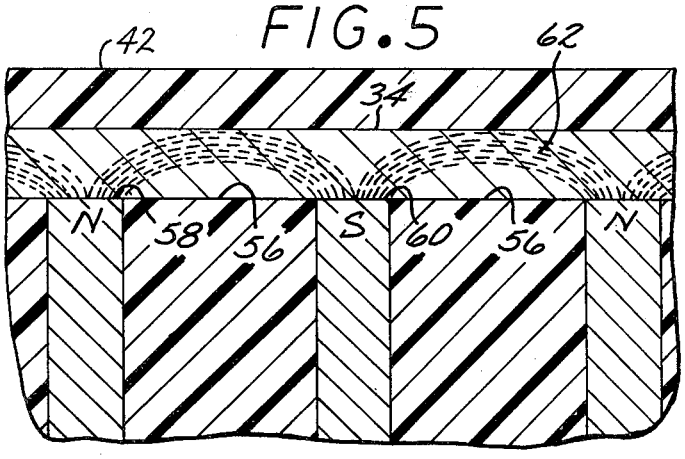
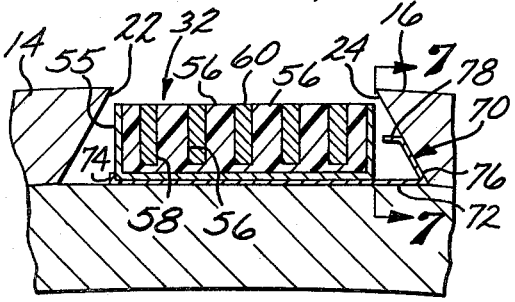
FIG. 4

MAGNETIC PRINTING SADDLE

This application is a continuation of U.S. Ser. No. 961,470, filed Nov. 16, 1978 now abandoned.

BACKGROUND OF THE INVENTION

1. Field of the Invention:

The present invention relates generally to printing apparatus, and more particularly, to a drum and saddle type apparatus having a magnetic lockup assembly along one edge of a printing plate.

2. Description of the Prior Art:

In the past, print plates for rotary printing presses have typically been of two types. In one type, a thin flexible printing plate is directly mounted on the surface of a cylinder drum and the edges of the plate are fastened by various means into recesses in the drum. In a second type, one or more cylindrically shaped saddles are mounted on the surface of the drum with spaces between the saddles for inserting the lockup mechanism which holds the printing plate onto the surface of the saddle. Typically, the edges of the saddles are beveled inwardly and at least one edge of the printing plate is bent inwardly to engage the beveled edge in the recess between the saddles. The opposite edge of the printing plate has been formed in many different configurations to cooperate with various mechanical lockup mechanisms which engage the other edge of the plate and apply some tension to securely mount the plate on the saddles. The saddle technique greatly increases the versatility of the roller printing presses in that saddles and lockup mechanisms may be replaced or changed without removing the drum from the press. While there are many types of lockup mechanisms for printing plates, almost all require some kind of mechanical actuation by the workman in order to insert or remove a plate. Typically, this means operating in very close spaces with great possibility of injury to the workman or marring the printing plate due to excessive handling. Additionally, the lockup mechanisms are usually relatively complicated mechanically and expensive to both maintain and to originally construct.

Thus, there has been a need in the field of saddle lockup techniques which is simple mechanically and requires a minimum of operation by the workman in locking or unlocking a printing plate over a saddle. The present invention satisfies that need.

SUMMARY OF THE INVENTION

The present invention provides a printing apparatus of the saddle type including a magnetic printing plate lockup mechanism. Conventional saddles having inwardly beveled edges are utilized in conjunction with an elongated vertically aligned laminated alternate pole magnet assembly mounted in the space between saddles. A printing plate having one edge thereof inwardly bent to engage a beveled edge of a saddle may be wrapped around the saddle. The opposite edge of the plate has a locking pad configuration for engagement with the magnet in the space between the saddles. The lockup pad configuration is offset downwardly at a slight angle to provide a biasing surface. As the locking pad edge is depressed downwardly over the beveled edge of the saddle, it engages the biasing surface to tightly lock the plate onto the outer surface of the saddle and the magnetic pad is engaged by the magnet to hold the structure in place. An index clip is mounted on the saddle and is cooperative with an indexing slot formed in the edge of the magnetic pad of the printing plate to maintain registry of the plate on the surface of the saddle. As either the bent over edge of the plate, or the magnetic lockup configuration, may be utilized over either edge of the saddle, to either engage the beveled edge or engage the lockup magnet, the plates may be placed on the saddle in either direction for added versatility.

An alternate embodiment of the invention provides for the utilization of saddles with radially oriented edges cooperative with circumferentially aligned laminated alternate pole magnet with gaps between its end poles and the edges of the saddles. Printing plates having edges bent at right angles are utilized with the radially extending edges fitting in the gap between the magnet and the edge of the saddle, effectively magnetically locking the printing plates in place.

Thus, the printing apparatus of the present invention provides a saddle type drum with conventional saddles having inwardly beveled edges with elongated alternate pole locking magnets mounted in spaces between alternate saddles. A printing plate is provided which has a conventional inwardly angled bent edge and an opposite edge including an inclined tensioning ramp ending with a locking pad which engages the magnet, tensioning of the printing plate being provided by the tensioning ramp with the outer edge of the beveled edge of a saddle. The combination providing for the mounting of printing plates in either direction on the saddles. An alternate embodiment has horizontally aligned locking magnets cooperative with right angled bent edges of printing plates.

DESCRIPTION OF THE DRAWINGS

FIG. 1 is a partial perspective view of a printing apparatus constructed in accordance with the present invention;

FIG. 2 is a partial edge view of the magnetic locking configuration of the invention, illustrating the locked and unlocked positions of the locking pad of a printing plate;

FIG. 3 is a partial longitudinal edge view of a printing drum showing the locking magnet mounted in place;

FIG. 4 is an enlarged partial sectional view of a locking magnet and saddles taken in the direction of lines 4—4 of FIG. 3;

FIG. 5 is a fragmentary cross-sectional view of a second embodiment of the printing lockup construction of the present invention and depicting a locking pad in place on a locking magnet;

FIG. 6 is a fragmentary cross-sectional view of a third embodiment for the locking magnet and plates of the present invention; and FIG. 7 is a transverse sectional view taken along the line 7—7 of FIG. 4.

DESCRIPTION OF THE PREFERRED EMBODIMENT

Turning now to the drawings, particularly FIG. 1 thereof, there is shown a fragmentary perspective view of a printing roller 10 for use with a rotary printing press. Printing roller 10 includes a cylindrical drum 12, on which are mounted a pair of opposed semi-cylindrical saddles, 14 and 16 respectively. As is best seen in FIG. 2, the saddles 14 and 16 have longitudinal edges 18, 20, 22 and 24 respectively, which are radially inwardly beveled to form acute angles with the outer surface of the saddles. The proximate edges 18 and 20 of such opposed saddles are spaced from each other to form therebetween a longitudinal recess 26 and the opposite edges 22 and 24 are similarly spaced from each other to form a longitudinal recess 28.

Centrally mounted within the recesses 26 and 28, are a pair of elongated axially extending magnetic lockup bars 30 and 32 (FIG. 1), which extend radially outwardly from the drum. In practice, a ferromagnetic printing plate 34 having a first longitudinal edge 36, is bent over at an acute angle along such edges to form a hook 38 which engages beveled edge 18 of the saddle 14. The printing plate 34 has an opposite edge forming an offset lockup pad or band 37 joined with the body of such plate along the length thereof by an angled tensioning ramp 39. The ramp 39 is preferably set at an angle of about 90° to the body of the plate 34.

A similar opposed plate 44, has a similar angled edge 46, including a hook 48, which makes an acute angle with the body of the plate 44, corresponding to the beveled edge 24 of the saddle 16. The opposite edge of the plate 44 is offset to form a tensioning ramp 49 and includes a lockup pad or band 50. Referring to FIGS. 4 and 5, the bars include a C-channel aluminum frames 55 having a plurality of parallel and longitudinally extending magnetic strips received therein and embedded in a suitable support medium 56, such as for example, non-magnetic molded epoxy. The magnetic strips have alternate pole configurations so that, for example, strips 58 may have a north pole configuration while alternate magnetic strips 60 will have a south pole configuration. This alternate pole arrangement insures a strong magnetic flux field between alternate poles to more intensely magnetically attract the lockup band 37. The locking magnetic force may be further enhanced by overlying the lockup pad 37 with a ferromagnetic stiffener 42 (FIG. 5). This overall effect is seen graphically illustrated in FIG. 5, in which a magnetic strip 58 with a north pole piece and a magnetic strip 60 with a south pole piece, has phantom magnetic force lines between them which are practically completely confined to the surface of the plate 34 and overlying stiffener 42, if it should be constructed of a magnetic material. While not shown in FIG. 5, the lower ends of strips 58 and 60 have similar flux lines which pass through the non-magnetic support medium 56.

The longitudinal construction of the magnetic lockup bar 32 is shown in FIG. 3 and includes a pair of end-to-end elongated lockup bar sections 64 and 66 separated by a non-magnetic spacer 68. Underlying the centrally located spacer 68 is a circumferentially extending registration clip, generally designated 70, and having a flat back wall 72 turned up on one end to form a flange 74 and being angled back on itself at its opposite extremity to form an index riser 76 projecting at the same angle as the beveled edge 24 of the saddle 16 (FIG. 4) and then turns back on itself to form an index lip 78. The plate hook 48 is formed centrally with an index slot that complimentally fits over the outline of the index clip 70 depicted in FIG. 7 to register such plate transversely on the saddle 16. A similar registration clip 20 is mounted under the spacer 68 separating the lockup bars 30 mounted opposite the bar 32 (FIG. 2).

When the printing plate 34 is to be mounted on the saddle 14, the connector hook 38 is hooked over the beveled edge 18 of the saddle 14 with the registration slot thereof 79 (FIG. 1) fitted over the registration clip riser 76 as shown in FIG. 2 and the body of the plate wrapped around such saddle and the tensioning ramp 39 (FIG. 2), engaged with the opposite longitudinal edge of such saddle. The plate in the area of such ramp 39, is then pressed downwardly to tension the plate firmly on the saddle and the magnetic pad 37 will then be attracted firmly to the magnetic locking bar 32. The drum 10 may then be rotated so the hook 48 of the opposed plate 44 can be received on the saddle edge 24 (FIG. 2) with the registration slot thereof registered over the riser 76 (FIG. 7) and the body of such plate wrapped about the saddle 16 and the tensioning ramp 49 engaged with the beveled edge 20 of the saddle 16 to be pressed downwardly to enable the magnetic locking bar 32 to draw the pad 50 firmly into contact therewith. The plates 34 and 44 are then in position for rotation of the drum 10 and printing of paper passed thereover.

When the printing drum is then rotated against a drum carrying the paper to be printed, indicia on the printing plate 34 will be transferred to such paper and as the lockup bars 30 and 32 respectively are rotated therepast, the respective ferromagnetic pads 37 and 50 will pass such paper spaced therefrom to thus avoid any imprint or marking on such paper at any point within the confines of the recesses receiving such bars 30 and 32, thereby preventing any marking thereon. Thus, it will be appreciated that the lockup construction of the present invention provides for a discrete magnetic lockup bar which may be conveniently and inexpensively inserted between relatively inexpensive-to-manufacture saddles and the ferromagnetic locking pad 37 or 50 brought into contact therewith will maintain a secure lock therewith. During operation, the magnetic bar itself will not be brought into direct physical contact with the mating paper roller, thus preventing contact of the magnetic pad with the print paper and protecting the lockup bars 30 and 32 themselves from being pounded against the print roller during each revolution of the print drum.

FIG. 6 is a fractional cross-sectional view of an alternate embodiment of the magnetic lockup bar in which saddles 109 and 81 are mounted on opposite sides of a drum with a space between their respective edges 96 and 98 which forms a recess 80 in which is mounted an elongated magnetic lockup bar 99 having a laminated alternate pole magnet configuration which has its laminations circumferentially oriented rather than radially oriented as in the first embodiment. The opposite sides of such lockup bar are formed with parallel flat radial surfaces 81 and 83.

In this configuration, a printing plate 84 has one edge which bent down at 94° to form a hook 86 which may be hooked over the edge 96 to be magnetically engaged with the edge 81 of the lockup bar 99 to securely hold it in place. Similarly, the marginal edge of an opposed printing plate 92 is bent down at 90° to form a ferromagnetic pad 90 hooked over the edge of the opposed saddle 91 to engage the opposite side 83 of the lockup bar 99 to be held magnetically in position. It will be appreciated that the marginal edge of the plate 84 opposite the hook 86 is also formed with a hook similar to the hook 38 for hooking over the opposite edge of the saddle similar to the saddle 18 of the saddle 14 (FIG. 2).

Thus, the present invention provides a magnetic lockup combination for printing plates made of a ferromagnetic material which is inexpensive to manufacture and easy to use. When a magnetic tab strip 36 is pushed into the recess containing the magnetic lockup bar, a tensioning ramp engages the outer edge of the saddle and by ramp action, applies tension on the plate to securely hold it on the saddle. An alternate form of the invention is to provide a circumferentially oriented lockup bar having its laminations directed tangential to the cylinder 12 which provides magnetic attraction for the marginal ends of a printing plate directed in a radial direction.

While three alternate embodiments of the present invention have been described in detail, it should be appreciated that other alternate forms of construction may be employed. Therefore, the invention is not to be limited except by the following claims.

I claim:

1. A magnetically locked printing saddle apparatus for a web printing press and comprising:

an axially elongated printing cylinder;

printing saddle means of predetermined radial thickness mounted on said cylinder and terminating in first and second axial edges spaced apart to form therebetween an axial groove having a radial depth corresponding with said predetermined radial thickness;

an axially elongated magnetic lockup bar disposed on said cylinder in said axial groove and formed with an outwardly facing magnetic locking surface;

mounting means mounting said lockup bar from said cylinder; and, a flexible printing plate for mounting on said saddle and inlcuding respective oppositely disposed first and second extremities, said first extremity being engagable with said first axial edge and said second extremity is formed with a radially inwardly turned leg projecting substantially perpendicular to the tangent of the circumferential surface of said saddle at said second edge to engage said second edge and lock said plate from shifting circumferentially on said saddle away from said groove, said second extremity then being bent to project circumferentially from said leg to form said pad disposed over said radially outwardly facing magnetic surface.

2. A magnetically locked printing saddle apparatus as defined in claim 1 wherein:

said magnetic lockup bar is configured to dispose said magnetic locking surface facing radially outwardly and to recess said surface radially inwardly from the cylindrical outline formed by a continuation of the outer circumferential surface of said saddle.

3. A magnetically locked printing saddle apparatus as defined in claim 1 wherein:

said lockup bar is formed by a plurality of radially outwardly extending and coextensive spaced apart magnetic strips mounted in a separating support structure of a non-magnetic material, said magnetic strips having radially outwardly facing alternate north and south poles.

4. A magnetically locked printing saddle apparatus as defined in claim 1 wherein:

said locking pad is formed with an index slot; and, said lockup bar includes at least one index clip projecting radially outwardly to engage said index slot to align said printing plate on said saddle.

5. A magnetically locked printing saddle lockup apparatus as defined in claim 1 that includes:

a stiffener strip overlying said pad.

6. A magnetically locked printing saddle apparatus as defined in claim 1 wherein:

said printing plate is constructed of ferromagnetic material.

7. A magnetically locked printing saddle apparatus as set forth in claim 1 wherein:

said lockup bar is substantially continuous to project substantially the full length of said printing cylinder.

8. A magnetically locked printing saddle apparatus as set forth in claim 1 wherein:

said lockup bar has a radial thickness less than said predetermined radial thickness and said bar is formed with said magnetic locking surface facing radially outwardly and projecting generally circumferentially of said cylinder at a selected radial distance below the cylindrical outline of the extension of the exterior circumferential surface of said saddle; and, said second extremity of said plate is formed with said pad projecting circumferentially to engage said magnetic surface.

9. A magnetically locked printing saddle apparatus as defined in claim 5 wherein:

said stiffener strip is constructed of ferromagnetic material.

* * * * *